US010352150B2

(12) United States Patent
Coste et al.

(10) Patent No.: US 10,352,150 B2
(45) Date of Patent: Jul. 16, 2019

(54) SYSTEM AND METHOD FOR DOWNHOLE AND SURFACE MEASUREMENTS FOR AN ELECTRIC SUBMERSIBLE PUMP

(71) Applicant: Schlumberger Technology Corporation, Sugar Land, TX (US)

(72) Inventors: Emmanuel Coste, Houston, TX (US); Jeffery Anderson, Beaumont (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 65 days.

(21) Appl. No.: 15/315,023

(22) PCT Filed: Jun. 30, 2015

(86) PCT No.: PCT/US2015/038476
§ 371 (c)(1),
(2) Date: Nov. 30, 2016

(87) PCT Pub. No.: WO2016/003998
PCT Pub. Date: Jan. 7, 2016

(65) Prior Publication Data

US 2017/0101863 A1 Apr. 13, 2017

Related U.S. Application Data

(60) Provisional application No. 62/020,834, filed on Jul. 3, 2014.

(51) Int. Cl.
*E21B 47/00* (2012.01)
*E21B 47/12* (2012.01)
(Continued)

(52) U.S. Cl.
CPC ..... *E21B 47/0007* (2013.01); *E21B 43/128* (2013.01); *E21B 47/12* (2013.01);
(Continued)

(58) Field of Classification Search
CPC .... E21B 43/128; E21B 47/0007; E21B 47/12; E21B 47/124
See application file for complete search history.

(56) References Cited

U.S. PATENT DOCUMENTS 6,590,362 B2 7/2003 Parlos et al.
6,713,978 B2 3/2004 Parlos et al.
(Continued)

FOREIGN PATENT DOCUMENTS

WO 2009005876 A2 1/2009
WO 2012145222 A1 10/2012
(Continued)

OTHER PUBLICATIONS

PCT/US2015/038476 International Search Report and Written Opinion, dated Sep. 30, 2015, 12 pgs.

*Primary Examiner* — Manuel L Barbee

(57) ABSTRACT

A method for monitoring an electric submersible pump. The method includes acquiring data indicative of surface measurements obtained while the pump is operating in a downhole environment, acquiring data indicative of downhole measurements obtained while the pump is operating in the downhole environment, storing the downhole data in the downhole environment, periodically transmitting the downhole data from the downhole environment to a remote computing device, and establishing a baseline signature profile based on a correlation of the surface data with the downhole data.

18 Claims, 5 Drawing Sheets

(51) Int. Cl.
*F04D 13/10* (2006.01)
*F04D 15/00* (2006.01)
*E21B 43/12* (2006.01)

(52) U.S. Cl.
CPC ..... *E21B 47/124* (2013.01); *F04D 13/10* (2013.01); *F04D 15/0088* (2013.01)

(56) References Cited

U.S. PATENT DOCUMENTS

| | | | | |
|---|---|---|---|---|
| 7,024,335 | B1 | 4/2006 | Parlos | |
| 2003/0000300 | A1 * | 1/2003 | Wong | E21B 47/04 73/152.14 |
| 2005/0173114 | A1 | 8/2005 | Cudmore et al. | |
| 2007/0252717 | A1 | 11/2007 | Fielder | |

FOREIGN PATENT DOCUMENTS

| | | | | |
|---|---|---|---|---|
| WO | 2013055566 | A1 | 4/2013 | |
| WO | WO-2013055566 | A1 * | 4/2013 | E21B 43/128 |

* cited by examiner

SYSTEM AND METHOD FOR DOWNHOLE AND SURFACE MEASUREMENTS FOR AN ELECTRIC SUBMERSIBLE PUMP

CROSS-REFERENCE TO RELATED APPLICATIONS

The present application claims priority to U.S. Provisional Application No. 62/020,834 filed Jul. 3, 2014, and entitled "Combined Downhole and Surface Measurements for an Electric Submersible Pump" which is incorporated herein in its entirety for all purposes.

STATEMENT REGARDING FEDERALLY SPONSORED RESEARCH OR DEVELOPMENT

Not applicable.

BACKGROUND

Electric submersible pumps (ESPs) may be deployed for any of a variety of pumping purposes. For example, where a substance (e.g., hydrocarbons in an earthen formation) does not readily flow responsive to existing natural forces, an ESP may be implemented to artificially lift the substance. If an ESP fails during operation, the ESP must be removed from the pumping environment and replaced or repaired, either of which results in a significant cost to an operator.

The ability to predict an ESP failure, for example by monitoring the operating conditions and parameters of the ESP, provides the operator with the ability to perform preventative maintenance on the ESP or replace the ESP in an efficient manner, reducing the cost to the operator. However, when the ESP is in a borehole environment, it is difficult to monitor the operating conditions and parameters with sufficient accuracy to accurately predict ESP failures.

SUMMARY

Embodiments of the present disclosure are directed to a method for monitoring an electric submersible pump. The method includes acquiring data indicative of surface measurements obtained while the pump is operating in a downhole environment, acquiring data indicative of downhole measurements obtained while the pump is operating in the downhole environment, storing the downhole data in the downhole environment, periodically transmitting the downhole data from the downhole environment to a remote computing device, and establishing a baseline signature profile based on a correlation of the surface data with the downhole data.

Other embodiments of the present disclosure are directed to a system for monitoring an electric submersible pump. The system includes a downhole sensor coupled to the pump to measure a downhole measurement of the pump and store data indicative of the downhole measurement, a surface-based power meter to measure a surface measurement associated with the pump, and a processor coupled to the sensor and power meter. The processor—in some cases in response to the execution of instructions stored on a non-transitory computer-readable medium—acquires data from the power meter indicative of surface measurements while the pump is in a downhole environment, acquires data from the sensor indicative of downhole measurements while the pump is in the downhole environment, periodically receives the downhole data from the downhole environment, and establishes a baseline signature profile based on a correlation of the surface data with the downhole data.

The foregoing has outlined rather broadly a selection of features of the disclosure such that the detailed description of the disclosure that follows may be better understood. This summary is not intended to identify key or essential features of the claimed subject matter, nor is it intended to be used as an aid in limiting the scope of the claimed subject matter.

BRIEF DESCRIPTION OF THE DRAWINGS

Embodiments of the disclosure are described with reference to the following figures.

DETAILED DESCRIPTION

Figure 1:
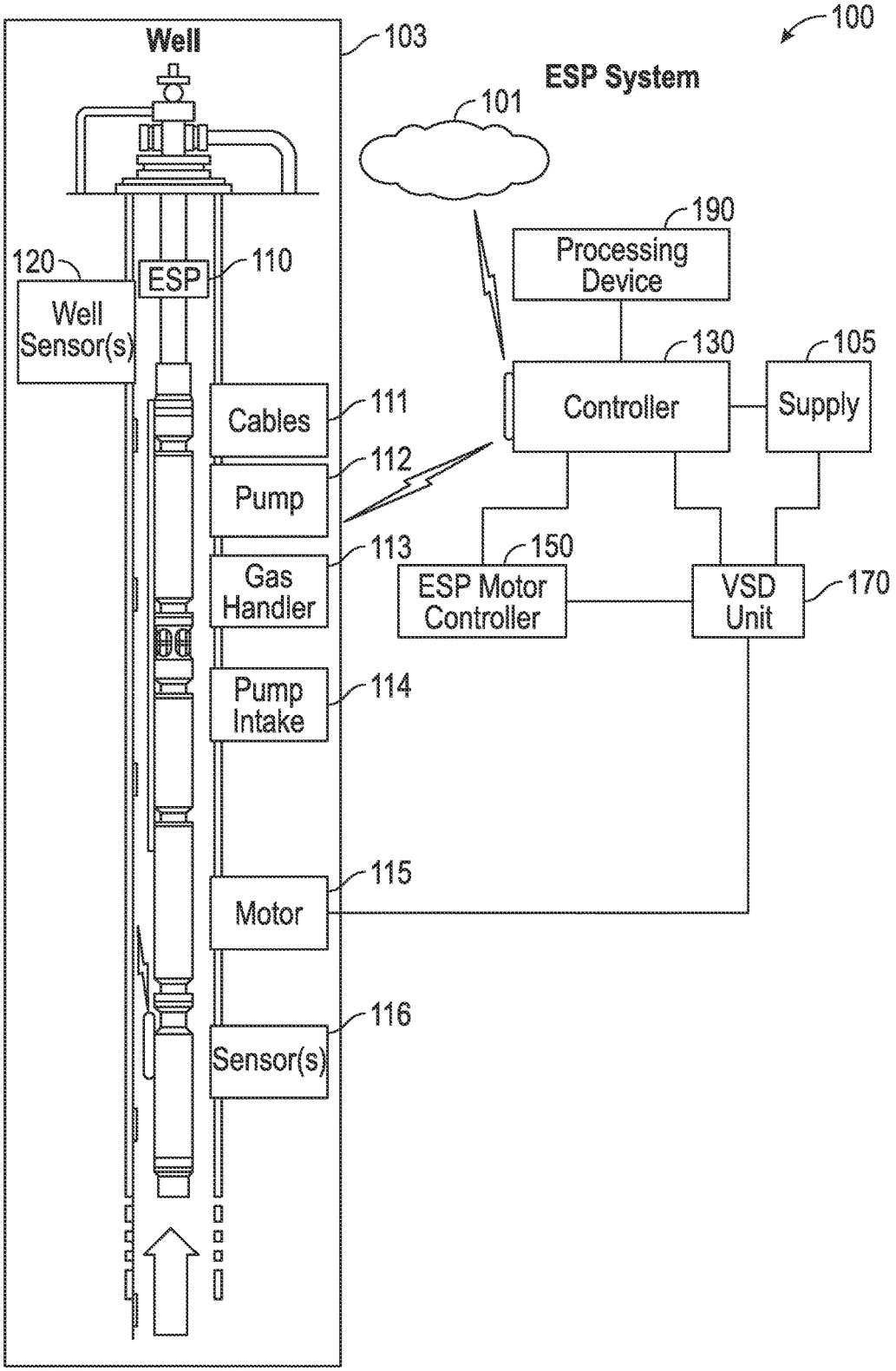
FIG. 1 illustrates an electric submersible pump and associated control and monitoring system deployed in a wellbore environment in accordance with various embodiments of the present disclosure.

One or more embodiments of the present disclosure are described below. These embodiments are merely examples of the presently disclosed techniques. Additionally, in an effort to provide a concise description of these embodiments, all features of an actual implementation may not be described in the specification. It should be appreciated that in the development of any such implementation, as in any engineering or design project, numerous implementation-specific decisions are made to achieve the developers' specific goals, such as compliance with system-related and business-related constraints, which may vary from one implementation to another. Moreover, it should be appreciated that such development efforts might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The embodiments discussed below are intended to be examples that are illustrative in nature and should not be construed to mean that the specific embodiments described herein are necessarily preferential in nature. Additionally, it should be understood that references to "one embodiment" or "an embodiment" within the present disclosure are not to be interpreted as excluding the existence of additional embodiments that also incorporate the recited features. The drawing figures are not necessarily to scale. Certain features and components disclosed herein may be shown exaggerated in scale or in somewhat schematic form, and some details of conventional elements may not be shown in the interest of clarity and conciseness.

The terms "including" and "comprising" are used herein, including in the claims, in an open-ended fashion, and thus should be interpreted to mean "including, but not limited to . . . ." Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. If the connection transfers electrical power or signals, the coupling may be through wires or other modes of transmission. In some of the figures, one or more components or aspects of a component may be not displayed or may not have reference numerals identifying the features or components that are identified elsewhere in order to improve clarity and conciseness of the figure.

Electric submersible pumps (ESPs) may be deployed for any of a variety of pumping purposes. For example, where a substance does not readily flow responsive to existing natural forces, an ESP may be implemented to artificially lift the substance. Commercially available ESPs (such as the REDA™ ESPs marketed by Schlumberger Limited, Houston, Tex.) may find use in applications that require, for example, pump rates in excess of 4,000 barrels per day and lift of 12,000 feet or more.

To improve ESP operations, an ESP may include one or more sensors (e.g., gauges) that measure any of a variety of phenomena (e.g., temperature, pressure, vibration, etc.). A commercially available sensor is the Phoenix MultiSensor™ marketed by Schlumberger Limited (Houston, Tex.), which monitors intake and discharge pressures; intake, motor and discharge temperatures; and vibration and current leakage. An ESP monitoring system may include a supervisory control and data acquisition system (SCADA). Commercially available surveillance systems include the LiftWatcher™ and the LiftWatcher™ surveillance systems marketed by Schlumberger Limited (Houston, Tex.), which provides for communication of data, for example, between a production team and well/field data (e.g., with or without SCADA installations). Such a system may issue instructions to, for example, start, stop or control ESP speed via an ESP controller.

As explained above, it is difficult to monitor the operating conditions and parameters of an ESP while deployed in a borehole environment with sufficient accuracy to predict ESP failures. In the case of a surface mechanical rotating device such as a pump or motor, sensors (e.g., accelerometers, power meters, and vibration detectors) may be deployed to acquire data with a high sampling rate, for example up to tens of kHz, to detect early signs of failures on the rotating device.

However, ESP systems may be deployed downhole into a terrestrial-based wellbore by a cable. In terrestrial deployments, traditional methods for the determination of pump performance using vibration analysis are limited due to factors affecting the vibration data acquired downhole including: (i) that the vibration sensor positions are not optimal; (ii) the data is insufficiently sampled to enable failure detection (e.g., 1 Hz sampling); and (iii) the bandwidth available to transfer data acquired downhole to the surface is limited to a few hundred bytes per second, preventing the transfer of high-resolution data, such as vibration data, to the surface. Undersea-deployed ESP systems are more difficult to monitor than terrestrial-deployed systems. Because of the difficulty in monitoring undersea-deployed ESP systems coupled with the lengthy and expensive production delays that occur when such systems fail, ESP systems are typically not used in undersea wellbore environments.

Embodiments of the present disclosure may utilize various sensors, for example contained in a downhole gauge, which together are capable of sampling, processing, and/or storing high-resolution or high-frequency data (e.g., up to several kHz or more) downhole. Additionally, embodiments of the present disclosure may utilize a surface unit, such as a computer or other computing device, to monitor or acquire data indicative of downhole conditions, but not received from the gauge or sensors. One example of such a surface unit includes power meter or analyzer at the surface that may acquire load voltage and/or current data at a high sampling rate (e.g., several kHz or more), which may then be analyzed to generate an estimation of vibration generated by, or imparted to, the downhole equipment such as the ESP or an associated motor.

Thus, the downhole sensors or gauge acquire data indicative of downhole measurements (or "downhole data") such as vibration, pressure, temperature, fluid flow rates, and the like, in a high-frequency or high-resolution manner, which enables a faithful capture of the downhole conditions affecting the ESP. However, as noted, in certain cases the bandwidth available to transfer data acquired downhole by the sensors or gauge may be insufficient (e.g., a few hundred bytes per second) to transfer the high-resolution data to the surface in a real time or continual manner. Conversely, the surface unit acquires the data indicative of surface measurements (or "surface data") such as load voltage or current data in a high-frequency and real-time manner (i.e., there is no reliance on a bandwidth-constrained telemetry link to acquire the surface data), but only represents an estimate of actual downhole conditions such as vibration affecting the ESP.

To address these and other issues, embodiments of the present disclosure seek to establish a baseline during an early stage of rotating device life based on the surface data and/or the downhole data, which defines a certain "signature" or "profile" that corresponds to a healthy operating mode of the rotating device. For example, very shortly after downhole deployment of a rotating device such as an ESP, before the device is affected by mechanical failure or wear, data indicative of surface measurements such as load voltage or current data is acquired by a surface unit such as a power meter or analyzer. As explained above, this surface data is not constrained to transmission over a bandwidth-constrained telemetry link, and thus may be sampled at a high rate or continually. At the same time, data indicative of downhole measurements is acquired by a downhole gauge (or any suitable combination of sensors, processing circuitry, and memory) and stored downhole (e.g., in a memory component of the gauge). In some embodiments, the downhole data is collected at a singular position downhole while in other embodiments the downhole data is collected at multiple positions downhole.

As explained above, the downhole data may be a significant volume of data that cannot be transmitted continuously to the surface, and thus the downhole data may be stored downhole for a predetermined amount of time (e.g., one day or one week). After the prescribed amount of time, the downhole data is transmitted to the surface over the telemetry link. The periodicity of transmission need not remain static and in some embodiments may change in duration. The transmitted data may comprise a full-resolution waveform or the results of a frequency analysis or other processing of raw data collected by sensors. Once the downhole data is received by a remote computing device at the surface, a baseline signature profile is established based on both the received downhole data and the corresponding acquired surface data.

In this way, downhole data that is indicative of actual downhole conditions such as vibration affecting the ESP may be associated with corresponding surface data, which is an estimation of those same conditions. This results in a set or pair of signatures (i.e., a surface signature and a downhole signature) that indicate a known, healthy operation of the ESP. This acquisition of data may be synchronized, such that the data indicative of downhole conditions such as mechanical vibrations corresponds in time to the surface data, which may include electrical surface measurements. Further, either or both of the downhole data and the surface data may be further processed before they are correlated or associated with one another. In some embodiments, the baseline signature profile(s) may be used to populate a database. For example, a baseline signature profile may be established for each of a number of ESP operating conditions such as drive frequency, resulting in a database of baseline signature profiles for a wide variety of operating conditions that may be encountered in the field. In the case of multiple drive frequencies, the baseline signature may be considered as a function of drive frequency.

In some embodiments, the establishment of the baseline signature profile may be the result of computing a fast Fourier transform (FFT) or other frequency-based analysis of the sampled downhole data and surface electrical measurements collected after deployment. As one example, the database may contain a plurality of time and frequency domain-based signature profiles. As another example, the database may contain a plurality of FFTs of the surface and/or downhole data collected following deployment and before the ESP is affected by mechanical failure or wear.

Normal operation of the ESP or rotating device downhole may subsequently commence. Regardless of how the baseline signature profile(s) are established, embodiments of the present disclosure are also directed toward ongoing monitoring of ESP health or performance by leveraging both downhole and surface data. Similar to the above-described establishment of a baseline signature profile, the ongoing monitoring may also rely on periodic transmission of data collected from downhole sensors and processing and/or comparison of that periodically transmitted data with surface data or baseline signature profiles. In this way, high resolution data is able to be acquired downhole and utilized at the surface in a periodic manner for ESP monitoring.

As one example, an embodiment may include performing a frequency analysis, with FFT being one non-limiting example, in the downhole environment and subsequently transmitting, periodically, a result of the frequency analysis to the surface via the slow telemetry link. By comparing the transmitted result of the frequency analysis to the baseline signature profile, early signs of a potential ESP failure or degradation in performance may be detected if the difference between the result of the frequency analysis and the baseline signature is greater than a predetermined threshold. In other embodiments, these early signs may be a component of the frequency analysis absolutely exceeding a predetermined threshold. In still other embodiments, these early signs may be a combination of the result of the frequency analysis deviating from the baseline and absolutely exceeding various thresholds.

In some embodiments, an alert may be generated when a difference between the results of the frequency analysis of downhole data and the baseline signature profile is detected. As one example, the alert may indicate degradation of the ESP and/or the ESP's performance. The alert may include, for example, audio or visual components or a combination thereof. The alert may also include for example, but is not limited to, displaying a message on a monitor, sending an e-mail to one or more individuals responsible for monitoring the ESP, generating a sound, or combinations thereof.

Whether early signs of a potential failure are detected may be referred to as a health status of the ESP, and an ESP that displays no signs of failure may be deemed healthy, while an ESP displaying signs of potential or outright failure may be deemed unhealthy. In other examples, health status may refer to a determination made as to whether ESP performance is degrading; that is, whether performance is changing in a potentially negative manner, rather than whether ESP performance meets some absolute performance benchmark to be deemed healthy or unhealthy. For example, in determining the health status, an identification of the presence of an abnormal frequency component (e.g., a frequency component known to be likely indicative of impending failure) in the results of the frequency analysis may result in generating a failing indication. Similarly, in the absence of such abnormal frequency components, a passing indication may be generated.

Certain embodiments of the present disclosure may also leverage the results of the frequency analysis of the downhole data to recalibrate a surface component of the established baseline signature profile. As explained above, the downhole data provides an accurate representation of actual downhole conditions such as vibration affecting the ESP, whereas the surface data is an approximation or estimation of those same conditions based on an analysis of a load voltage and/or current at the surface. In a sense, then, the surface data is less precise and/or more prone to external influences, which may result in false alarms in some cases if ESP monitoring is based only on the surface data. To prevent these drawbacks associated with ESP monitoring based solely on surface data, embodiments of the present disclosure may detect a change in the surface data from the surface component of the baseline signature profile, such as an unexpected deviation in excess of a predetermined threshold. However, if the results of the frequency analysis of the downhole data do not indicate a change in the actual operating conditions downhole (i.e., the ESP operation is not degrading), then the surface component may be recalibrated or the database may be updated to reflect the new, changed surface data that still corresponds with a healthy operating mode of the ESP based on the downhole data. Of course, if a deviation is also perceived in the downhole data or results of a frequency analysis of the downhole data, then an alert may be generated as described above.

The recalibrated surface component of the baseline signature profile may be used as a more accurate estimate of the downhole vibration signature. The use of such an adjusted or calibrated surface component may also provide the additional benefit of higher-resolution acquisition. The comparison between surface and downhole data or frequency analysis results may be periodically updated and the calibration re-performed so that the surface component of the baseline signature profile more accurately tracks changes in the electrical configuration and/or downhole conditions. As an example, the surface and downhole comparison may be updated hourly, daily, or on a predetermined schedule, for example, every 4 hours. The recalibration of the surface component may occur immediately following the surface and downhole comparison or may occur according to an independent schedule.

Other embodiments of the present disclosure leverage the ability to continually monitor the surface electrical measurements using a power meter or analyzer without being constrained by the bandwidth-limited telemetry link. As above, the downhole parameters are still sampled at a high frequency and the raw data may be stored downhole, for example in a memory component of the gauge. However, as explained, this downhole data is quite voluminous and not suitable for continual transmission over the bandwidth-telemetry link. Thus, the surface electrical signatures may be continually monitored and compared against the baseline signature profile or predetermined ranges or thresholds to identify a change or fluctuation in the data indicating the surface electrical signature.

In the event that a change in the surface electrical signature is detected, a computing device may query or transmit a request to the downhole storage device (e.g., a gauge) to retrieve the stored raw data or a result of a frequency analysis from downhole. Thus, in these embodiments, the transmission of data from downhole to the surface occurs as a result of detecting a deviation or change in the monitored surface electrical signature, which may be monitored continually. As a result, the downhole data may be request in an on-demand type manner for subsequent diagnostic testing, which may be more illustrative of actual downhole conditions than the observed surface electrical signature. As an example, a frequency analysis such as FFT may be performed by the remote computing device on the surface on all or a portion of the full resolution data. The results of this frequency analysis may then be compared to the corresponding baseline signature profile(s) to detect differences therebetween. When a difference between the downhole data and the baseline is detected, an alert may be generated as above.

By leveraging both surface and downhole measurements to monitor ESP performance, high resolution downhole data that accurately reflects actual downhole conditions such as vibration affecting the ESP can be utilized for effective ESP monitoring even in the presence of a bandwidth-limited telemetry link. This is advantageous because while surface electrical measurements are available in a continual manner, these measurements are estimations or approximations of those downhole conditions and prone to generating false alarms. Thus, despite slow telemetry links, embodiments of the present disclosure utilize high resolution downhole data to calibrate surface-based monitoring solutions (e.g., a power meter/analyzer) and to identify deviations in pump health. Of course, embodiments of the present disclosure apply also to systems with more advanced downhole data links, but such high-speed links are not required.

Referring now to FIG. 1, an example of an ESP system 100 is shown. The ESP system 100 includes a network 101, a well 103 disposed in a geologic environment, a power supply 105, an ESP 110, a controller 130, a motor controller 150, and a VSD unit 170. The power supply 105 may receive power from a power grid, an onsite generator (e.g., a natural gas driven turbine), or other source. The power supply 105 may supply a voltage, for example, of about 4.16 kV.

The well 103 includes a wellhead that can include a choke (e.g., a choke valve). For example, the well 103 can include a choke valve to control various operations such as to reduce pressure of a fluid from high pressure in a closed wellbore to atmospheric pressure. Adjustable choke valves can include valves constructed to resist wear due to high velocity, solids-laden fluid flowing by restricting or sealing elements. A wellhead may include one or more sensors such as a temperature sensor, a pressure sensor, a solids sensor, and the like.

The ESP 110 includes cables 111, a pump 112, gas handling features 113, a pump intake 114, a motor 115 and one or more sensors 116 (e.g., temperature, pressure, current leakage, vibration, etc.). The well 103 may include one or more well sensors 120, for example, such as the commercially available OpticLine™ sensors or WellWatcher BriteBlue™ sensors marketed by Schlumberger Limited (Houston, Tex.). Such sensors are fiber-optic based and can provide for real time sensing of downhole conditions. Measurements of downhole conditions along the length of the well can provide for feedback, for example, to understand the operating mode or health of an ESP. Well sensors may extend thousands of feet into a well (e.g., 4,000 feet or more) and beyond a position of an ESP.

The controller 130 can include one or more interfaces, for example, for receipt, transmission or receipt and transmission of information with the motor controller 150, a VSD unit 170, the power supply 105 (e.g., a gas fueled turbine generator or a power company), the network 101, equipment in the well 103, equipment in another well, and the like. The controller 130 may also include features of an ESP motor controller and optionally supplant the ESP motor controller 150.

The motor controller 150 may be a commercially available motor controller such as the UniConn™ motor controller marketed by Schlumberger Limited (Houston, Tex.). The UniConn™ motor controller can connect to a SCADA system, the LiftWatcher™ surveillance system, etc. The UniConn™ motor controller can perform some control and data acquisition tasks for ESPs, surface pumps, or other monitored wells. The UniConn™ motor controller can interface with the Phoenix™ monitoring system, for example, to access pressure, temperature, and vibration data and various protection parameters as well as to provide direct current power to downhole sensors. The UniConn™ motor controller can interface with fixed speed drive (FSD) controllers or a VSD unit, for example, such as the VSD unit 170.

In accordance with various examples of the present disclosure, the controller 130 may include or be coupled to a processing device 190. Thus, the processing device 190 is able to receive data from ESP sensors 116 and/or well sensors 120. As explained above, the processing device 190 analyzes the data received from the sensors 116 and/or 120 to and a surface unit such as a power meter or analyzer to more accurately predict ESP 110 performance. The controller 130 and/or the processing device 190 may also monitor surface electrical conditions (e.g., at the output of the drive) to gain knowledge of certain downhole parameters, such as downhole vibrations, which may propagate through changes in induced currents. Thus, a vibration sensor may refer to a downhole gauge or sensor. The status of the ESP 110 or alerts related thereto may be presented to a user through a display device (not shown) coupled to the processing device 190, through a user device (not shown) coupled to the network 101, or other similar manners.

In some embodiments, the network 101 comprises a wireless or wired network and the user device is a mobile phone, a smartphone, or the like. In these embodiments, the prediction or identification of performance of the ESP 110 may be transmitted to one or more users physically remote from the ESP system 100 over the network 101. In some embodiments, the prediction of performance may be that the ESP 110 is expected to remain in its normal operating mode, or may be a warning of varying severity that a fault, failure, or degradation in ESP 110 performance is expected.

Regardless of the type of prediction of ESP 110 performance, certain embodiments of the present disclosure may include taking a remedial or other corrective action in response to a determination that the ESP 110 is expected to fail or experience degraded performance. The action taken may be automated in some instances, such that a particular type of determination automatically results in the action being carried out. Actions taken may include altering ESP 110 operating parameters (e.g., operating frequency) or surface process parameters (e.g., choke or control valve positions) to prolong ESP 110 operational life, stopping the ESP 110 temporarily and providing a warning to a local operator, control room, or a regional surveillance center.

Figure 2:
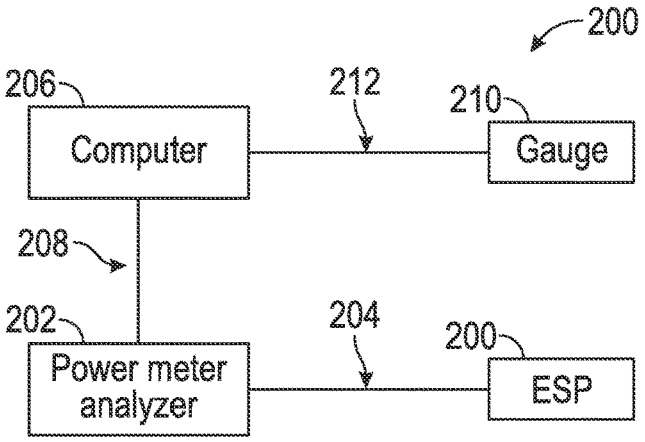
FIG. 2 illustrates a block diagram of a system for monitoring surface and downhole parameters associated with an electric submersible pump in accordance with various embodiments of the present disclosure.

FIG. 2 presents an example configuration of an ESP 200 in electrical communication with a power meter/analyzer 202 via connection 204, which may allow the power meter 202 to acquire load voltage and current related to the ESP 200. Power meter/analyzer 202 is in electrical communication with computing device 206 (e.g., including the processor 190 in FIG. 1) via connection 208, which permits transmission of data regarding, among other things, the load voltage and current related to ESP 200. Gauge 210 may be positioned adjacent to, proximate to, or in the vicinity of ESP 200 to acquire and store (e.g., in a memory component) vibration data related to ESP 200. Gauge(s) 210 are in electrical communication with the computer 206 via link 212. ESP 200 may also be in direct electrical communication with computer 206 via link 212 or via a separate communication link. ESP 200 may also be in direct electrical communication with one or more gauge(s) 210. One or more of communication links 204, 208, and 212 may be physical connections, such as twisted pair cable or fiber optic cable, or may indicate communication via wireless (RF) technologies like Bluetooth (802.15.1), Wi-Fi (802.11), Wi-Max (802.16), satellite, cellular transmission or the like.

Figure 3:
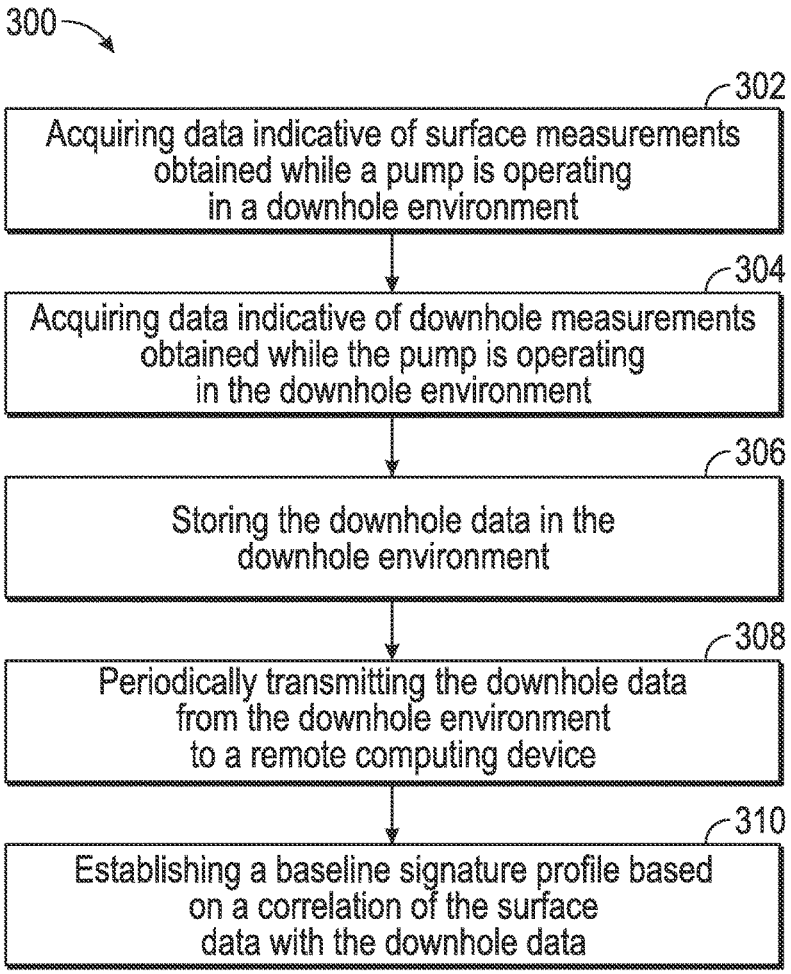
FIGS. 3-6 illustrate flow charts of various methods monitoring surface and downhole parameters associated with an electric submersible pump in accordance with various embodiments of the present disclosure.

FIG. 3 shows a method 300 for monitoring an ESP in accordance with various embodiments of the present disclosure. Although reference is generally made to a pump or ESP, embodiments of the present disclosure may be similarly applied to other rotating devices for which monitoring and determination of performance status is important. The method 300 begins in block 302 with acquiring data indicative of surface measurements obtained while a pump is operating in a downhole environment. The acquired data may be referred to as "surface data." As explained above, the surface data may be acquired from a surface unit such as power meter or analyzer at the surface that acquires load voltage and/or current data at a high sampling rate. The surface data is acquired in a high-frequency and real-time manner (i.e., there is no reliance on a bandwidth-constrained telemetry link to acquire the surface data), but only represents an estimate of actual downhole conditions such as vibration affecting the ESP.

The method 300 continues in block 304 with acquiring data indicative of downhole measurements also obtained while the pump is operating in the downhole environment. The acquired data may be referred to as "downhole data." The downhole data may be acquired by various types of sensors, for example in a downhole gauge. Embodiments of the present disclosure utilize a downhole gauge capable of high-frequency or high-resolution sampling of various operating parameters such as vibration, pressure, temperature, fluid flow rates, and the like, which enables a faithful capture of the downhole conditions affecting the ESP. However, as noted, in certain cases the bandwidth available to transfer data acquired downhole by the sensors or gauge may be insufficient (e.g., a few hundred bytes per second) to transfer the high-resolution data to the surface in a real time or continual manner.

To address this potential issue, the method 300 continues in block 306 with storing the downhole data in the downhole environment. For example, the downhole data may be stored in a memory component of a downhole gauge or other connected downhole memory. Notably, this allows the acquisition of high resolution data that accurately captures the conditions of the pump operation without requiring the acquired data to be continually transmitted to the surface, which is challenging where only a bandwidth-restricted link is available. In block 308, the method 300 continues with periodically transmitting (e.g., once a day or once a week) the downhole data from the downhole environment to a remote computing device at the surface. The periodicity of transmission need not remain static and in some embodiments may change in duration or may be event-driven, for example when the pump is turned off and the communication link may be able to sustain higher communication rates. The transmitted data may comprise a full-resolution waveform or the results of a frequency analysis or other processing of raw data collected by downhole sensors.

Once the downhole data is received by a remote computing device at the surface, the method 300 continues in block 310 with establishing a baseline signature profile based on both the received downhole data and the corresponding acquired surface data. In this way, downhole data that is indicative of actual downhole conditions such as vibration affecting the ESP may be associated with corresponding surface data, which is an estimation of those same conditions. This results in a set or pair of signatures (i.e., a surface signature and a downhole signature) that indicate a known, healthy operation of the ESP. In some embodiments, the baseline signature profile(s) may be used to populate a database. For example, a baseline signature profile may be established for each of a number of ESP operating conditions such as drive frequency, resulting in a database of baseline signature profiles for a wide variety of operating conditions that may be encountered in the field. In the case of multiple drive frequencies, the baseline signature may be considered as a function of drive frequency.

Figure 4:
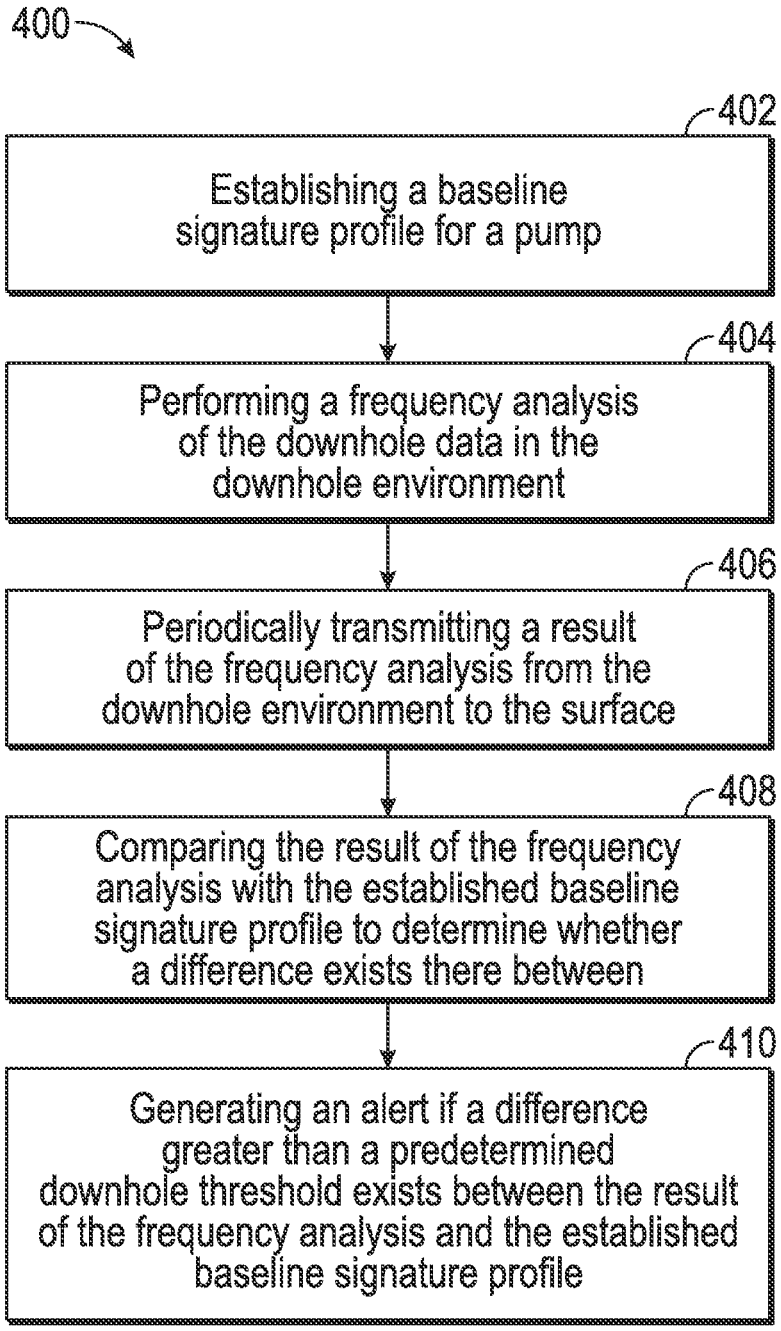

Turning now to FIG. 4, a method 400 is shown in accordance with certain embodiments of the present disclosure. The method 400 begins in block 402 with establishing a baseline signature profile for a pump. The baseline signature profile may be determined as explained above with respect to FIG. 3; however, other baseline signatures may be similarly used, and the method 400 is generally directed to utilizing surface and downhole measurements to provide ongoing monitoring of pump performance in order to predict defects or degradations in performance before they occur. To this end, the method 400 continues in block 404 with performing a frequency analysis of the downhole data in the downhole environment and in block 406 with periodically transmitting a result of the frequency analysis from the downhole environment to the surface. FFT is one non-limiting example of a type of frequency analysis, but it should be appreciated that other processing or analysis of acquired data sufficient to identify deviations in performance of the pump may be similarly applied.

The method 400 continues in block 406 with comparing the result of the frequency analysis with the established baseline signature profile to determine whether a difference exists therebetween. By comparing the transmitted result of the frequency analysis to the baseline signature profile, early signs of a potential ESP failure or degradation in performance may be detected if the difference between the result of the frequency analysis and the baseline signature is greater than a predetermined threshold. Further, since the method 400 only periodically transmits data acquired downhole to the surface, conventional bandwidth-limited links may be used even for the transmission of high resolution data that provides a more accurate portrayal of downhole conditions than surface measurement estimations alone. In some cases, the method 400 further continues in block 410 with generating an alert if a difference between the result of the frequency analysis and the established baseline signature profile exceeds a predetermined threshold. As explained above, the alert may indicate degradation of the ESP and/or the ESP's performance. The alert may include, for example, audio or visual components or a combination thereof. The alert may also include for example, but is not limited to, displaying a message on a monitor, sending an e-mail to one or more individuals responsible for monitoring the ESP, generating a sound, or combinations thereof. The alert may also be transmitted over a network to a remote user device.

Figure 5:
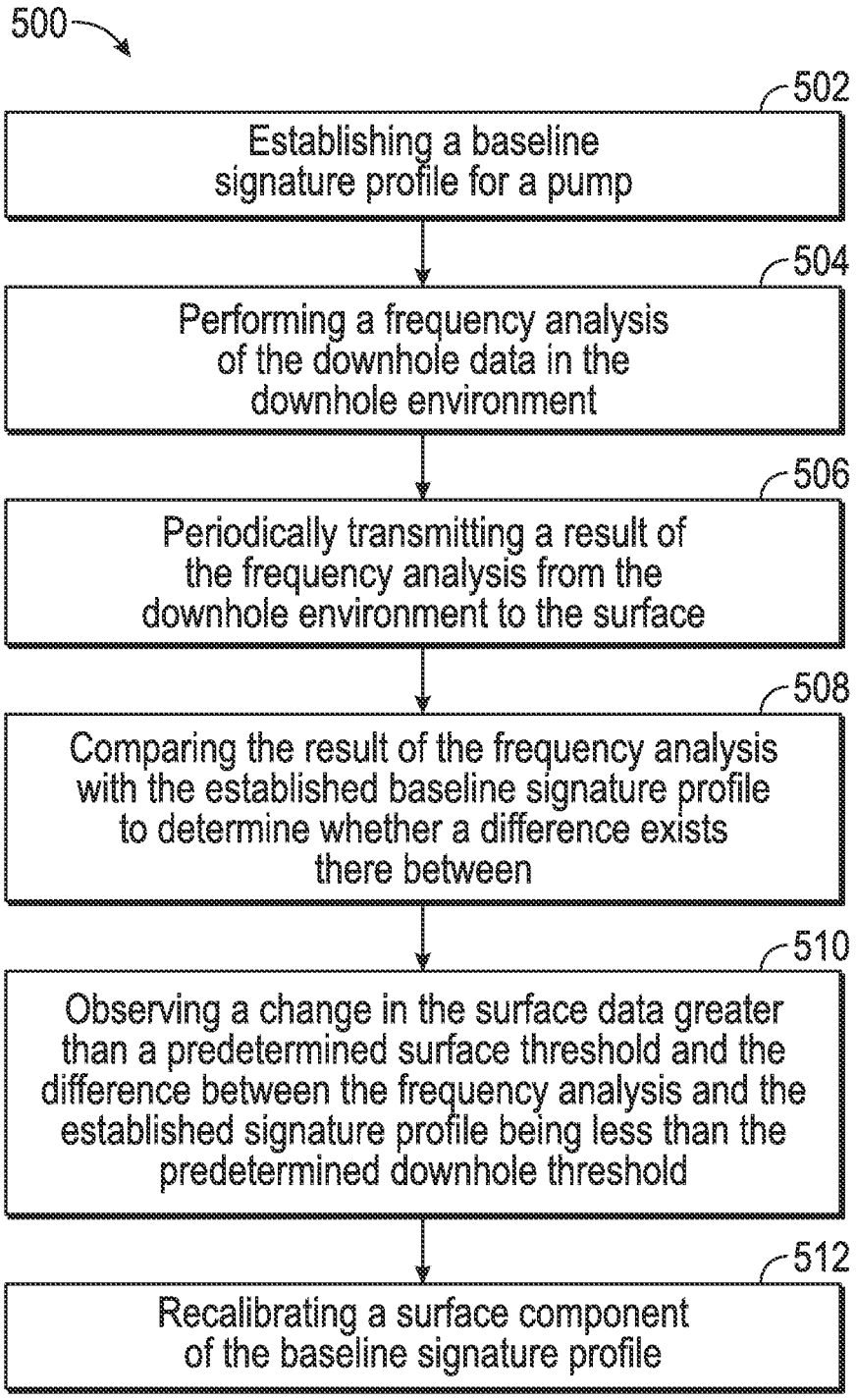

FIG. 5 shows another method 500 in accordance with various embodiments. Blocks 502-508 are similar to blocks 402-408 of the method 400 described above and are not presently addressed for brevity. The method 500 further includes in block 510 observing a change in the surface data (e.g., an absolute change in the acquired surface data or a change in the acquired surface data relative to a surface component of the baseline signature profile) greater than a predetermined threshold, where the downhole data has not exhibited significant changes. For example, if the results of the frequency analysis performed on the downhole data do not deviate from the established signature profile by more than a predetermined amount, it may be said that the downhole data has not undergone significant changes.

As explained above, the downhole data provides an accurate representation of actual downhole conditions such as vibration affecting the ESP, whereas the surface data is an approximation or estimation of those same conditions based on an analysis of a load voltage and/or current at the surface. In a sense, then, the surface data is less precise and/or more prone to external influences, which may result in false alarms in some cases if ESP monitoring is based only on the surface data. Thus, if the results of the frequency analysis of the downhole data do not indicate a change in the actual operating conditions downhole (i.e., the ESP operation is not degrading), then the surface component may be recalibrated in block 512 or the database may be updated to reflect the new, changed surface data that still corresponds with a healthy operating mode of the ESP based on the downhole data. Of course, if a deviation is also perceived in the downhole data or results of a frequency analysis of the downhole data, then an alert may be generated as described above.

Figure 6:
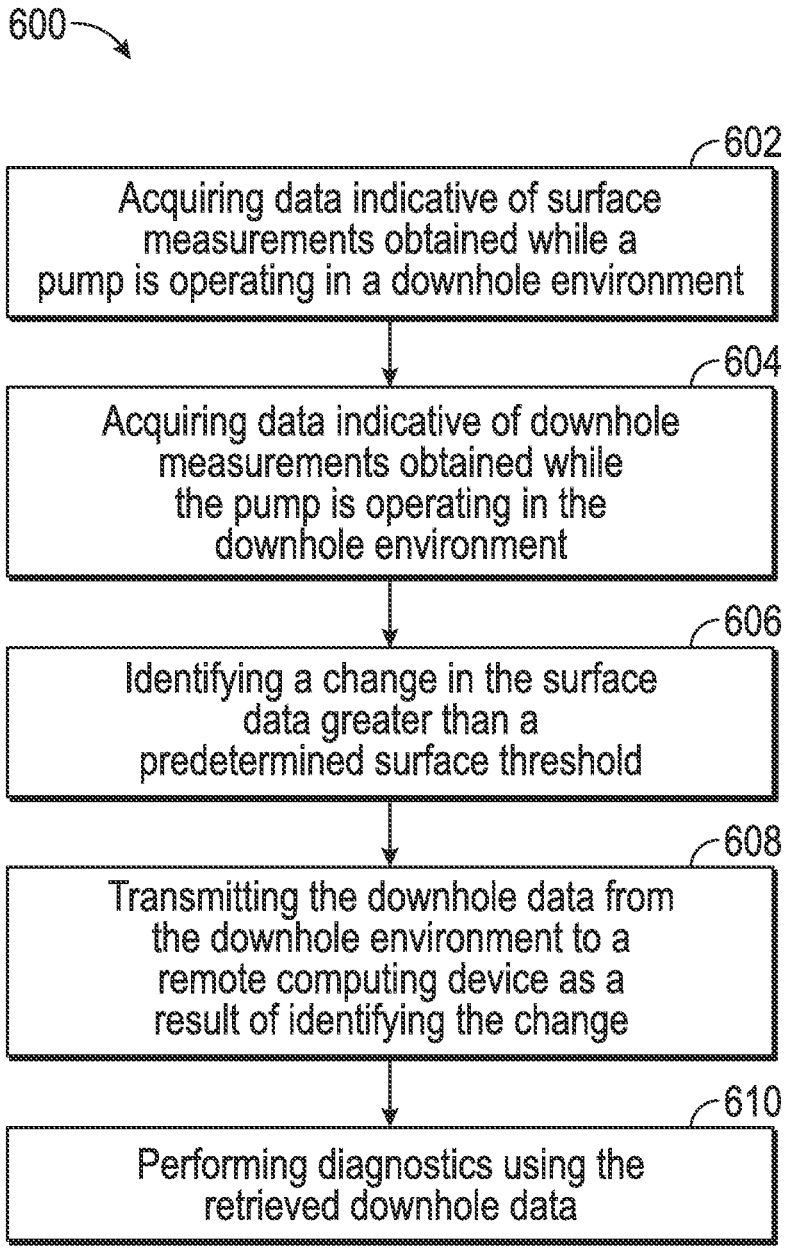

FIG. 6 shows an additional method 600 in accordance with certain embodiments of the present disclosure. Blocks 602 and 604 are similar to blocks 302 and 304 of the method 300 described above and are not presently addressed for brevity. As explained above, surface electrical measurements may be continually monitored by a power meter or analyzer without being constrained by the bandwidth-limited telemetry link. Further, downhole parameters are still sampled at a high frequency and the raw data may be stored downhole, for example in a memory component of a gauge. However, as explained, this downhole data is quite voluminous and not suitable for continual transmission over the bandwidth-telemetry link. Thus, the method 600 includes in block 606 identifying a change in the surface data (e.g., the surface electrical signatures) greater than a predetermined surface threshold. For example, the surface data may be continually monitored and compared against the baseline signature profile or predetermined ranges or thresholds to identify a change or fluctuation in the data indicating the surface electrical signature.

The method 600 continues in block 608 with transmitting the downhole data from the downhole environment to a remote computing device at the surface or otherwise away from the downhole environment as a result of identifying the change in block 606. For example, the computing device may query or transmit a request to the downhole storage device (e.g., a gauge) to retrieve the stored raw data or a result of a frequency analysis from downhole. As a result, the downhole data may be requested in an on-demand type manner for subsequent diagnostic testing as in block 610, which may be more illustrative of actual downhole conditions than the observed surface electrical signature.

Some of the methods and processes described above, including processes, as listed above, can be performed by a processor (e.g., processor 190). The term "processor" should not be construed to limit the embodiments disclosed herein to any particular device type or system. The processor may include a computer system. The computer system may also include a computer processor (e.g., a microprocessor, microcontroller, digital signal processor, or general purpose computer) for executing any of the methods and processes described above.

The computer system may further include a memory such as a semiconductor memory device (e.g., a solid-state flash memory drive (SSD), RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or Local Area Network).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Using the various embodiments of monitoring an ESP described herein, both surface and downhole measurements are leveraged to monitor ESP performance. This allows high resolution downhole data that accurately reflects actual downhole conditions such as vibration affecting the ESP to be utilized for effective ESP monitoring even in the presence of a bandwidth-limited telemetry link. Surface electrical measurements may be available in a continual manner, however these measurements are estimations or approximations of those downhole conditions and prone to generating false alarms. Thus, despite slow telemetry links, embodiments of the present disclosure utilize high resolution downhole data to calibrate surface-based monitoring solutions (e.g., a power meter/analyzer) and to identify deviations in pump health. Of course, embodiments of the present disclosure apply also to systems with more advanced downhole data links, but such high-speed links are not required.

Although only a few example embodiments have been described in detail above, those skilled in the art will readily appreciate that many modifications are possible in the example embodiments without materially departing from the electrical connector assembly. Features shown in individual embodiments referred to above may be used together in combinations other than those which have been shown and described specifically. Accordingly, all such modifications are intended to be included within the scope of this disclosure as defined in the following claims.

The embodiments described herein are examples only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A method for pumping fluid via an electric submersible pump of a fluid production system, comprising:

acquiring surface data indicative of surface measurements obtained while the electric submersible pump is operating in a downhole environment;

acquiring downhole data indicative of downhole measurements obtained while the electric submersible pump is operating in the downhole environment;

storing the downhole data in the downhole environment;

periodically transmitting the downhole data from the downhole environment to a remote computing device of the fluid production system;

establishing a baseline signature profile based on a correlation of the surface data with the downhole data;

performing, in the downhole environment, a frequency analysis of the downhole data;

periodically transmitting a result of the frequency analysis from the downhole environment to the remote computing device;

comparing the result of the frequency analysis with the established baseline signature profile to determine whether a difference exists therebetween; and based on the comparing, altering a parameter of the fluid production system that affects operation of the electric submersible pump.

2. The method of claim 1 further comprising generating an alert if a difference greater than a predetermined downhole threshold exists between the result of the frequency analysis and the established baseline signature profile.

3. The method of claim 1 further comprising recalibrating a surface component of the baseline signature profile in response to:

observing a change in the surface data greater than a predetermined surface threshold; and the difference between the frequency analysis and the established signature profile being less than the predetermined downhole threshold.

4. The method of claim 1 further comprising identifying a change in the surface data greater than a predetermined surface threshold, wherein a transmission of a result of the frequency analysis occurs in response to identifying such a change.

5. The method of claim 1 wherein the frequency analysis comprises a fast Fourier transform.

6. The method of claim 1 further comprising establishing, for each of a variety of pump operating conditions, signature profiles based on a correlation of the surface data with the downhole data.

7. The method of claim 1 wherein storing comprises storing the downhole data at a gauge proximate to the electric submersible pump.

8. A fluid production system for pumping fluid via an electric submersible pump, the fluid production system comprising:

downhole equipment that comprises a downhole sensor coupled to the electric submersible pump to measure a downhole measurement of the electric submersible pump while the pump is in a downhole environment and store downhole data indicative of the downhole measurement, wherein the downhole equipment performs a frequency analysis of the downhole data and periodically transmits a result of the frequency analysis to surface equipment, wherein the surface equipment comprises a surface-based power meter to measure a surface measurement associated with the electric submersible pump, and a processor coupled to the downhole sensor and the surface-based power meter, wherein the processor:

acquires surface data from the surface-based power meter indicative of surface measurements while the electric submersible pump is in the downhole environment;

periodically receives the downhole data from the downhole environment;

establishes a baseline signature profile based on a correlation of the surface data with the downhole data;

makes a comparison of the result of the frequency analysis with the established baseline signature profile to determine whether a difference exists therebetween; and based on the comparison, alters a parameter of the fluid production system that affects operation of the electric submersible pump.

9. The system of claim 8 further comprising a gauge proximate to the electric submersible pump and coupled to the downhole sensor to store the downhole data.

10. The fluid production system of claim 9 wherein the processor is further to identify a change in the surface data greater than a predetermined surface threshold, wherein a transmission of a result of the frequency analysis from the gauge to the surface equipment occurs in response to an identification of such a change.

11. The fluid production system of claim 8 wherein the processor is further to generate an alert if a difference greater than a predetermined downhole threshold exists between the result of the frequency analysis and the established baseline signature profile.

12. The fluid production system of claim 8 wherein the processor is further to recalibrate a surface component of the baseline signature profile in response to:

an observed change in the surface data greater than a predetermined surface threshold; and the difference between the frequency analysis and the established signature profile being less than the predetermined downhole threshold.

13. The fluid production system of claim 8 wherein the processor is further to establish, for each of a variety of pump operating conditions, signature profiles based on a correlation of the surface data with the downhole data.

14. A non-transitory computer-readable medium containing instructions that, when executed by a processor, cause the processor to:

acquire surface data indicative of surface measurements obtained while an electric submersible pump is operating in a downhole environment;

acquire downhole data indicative of downhole measurements obtained while the electric submersible pump is operating in the downhole environment, the downhole data having been stored in a downhole storage device in the downhole environment;

periodically receive the downhole data from the downhole storage device in the downhole environment;

establish a baseline signature profile based on a correlation of the surface data with the downhole data;

wherein the processor periodically receives a result of a frequency analysis of the downhole data from the downhole storage device and the instructions cause the processor to:

compare the result of the frequency analysis with the established baseline signature profile to determine whether a difference exists therebetween; and generate an alert if the difference is greater than a predetermined downhole threshold between the result of the frequency analysis and the established baseline signature profile; and based on the difference, alter a parameter of the fluid production system that affects operation of the electric submersible pump.

15. The non-transitory computer-readable medium of claim 14 wherein the instructions cause the processor to:

identify a change in the surface data greater than a predetermined surface threshold; and as a result of an identification of such a change, generate a query to the downhole storage device to transmit a result of a frequency analysis of the downhole data to the processor.

16. A method for pumping fluid via an electric submersible pump of a fluid production system, comprising:

acquiring surface data indicative of surface measurements obtained while the electric submersible pump is operating in a downhole environment;

acquiring downhole data indicative of downhole measurements obtained while the electric submersible pump is operating in the downhole environment;

storing the downhole data in the downhole environment;

periodically transmitting the downhole data from the downhole environment to a remote computing device of the fluid production system;

establishing a baseline signature profile based on a correlation of the surface data with the downhole data;

performing, in the downhole environment, a frequency analysis of the downhole data;

periodically transmitting a result of the frequency analysis from the downhole environment to the remote computing device;

identifying a change in the surface data greater than a predetermined surface threshold, wherein a transmission of a result of the frequency analysis occurs in response to identifying such a change; and based on the change, altering a parameter of the fluid production system that affects operation of the electric submersible pump.

17. A fluid production system for pumping fluid via an electric submersible pump, the system comprising:

a gauge that comprises a downhole sensor coupled to the electric submersible pump to measure a downhole measurement of the electric submersible pump while the pump is in a downhole environment and store downhole data indicative of the downhole measurement in a downhole storage device, wherein the gauge is to perform a frequency analysis of the downhole data and periodically transmit a result of the frequency analysis to surface equipment, wherein, the surface equipment comprises a surface-based power meter to measure a surface measurement associated with the electric submersible pump and a processor coupled to the downhole sensor and the surface-based power meter to:

acquire surface data from the surfaced-based power meter indicative of surface measurements while the electric submersible pump is in the downhole environment;

periodically receive the downhole data from the downhole environment;

establish a baseline signature profile based on a correlation of the surface data with the downhole data;

identify a change in the surface data greater than a predetermined surface threshold, wherein a transmission of a result of the frequency analysis from the gauge to the surface equipment occurs in response to an identification of such a change; and based on the change, alter a parameter of the fluid production system that affects operation of the electric submersible pump.

18. A non-transitory computer-readable medium containing instructions that, when executed by a processor, cause the processor to:

acquire surface data indicative of surface measurements obtained while an electric submersible pump is operating in a downhole environment;

acquire downhole data indicative of downhole measurements obtained while the electric submersible pump is operating in the downhole environment, the downhole data having been stored in a downhole storage device in the downhole environment;

periodically receive the downhole data from the downhole storage device in the downhole environment;

establish a baseline signature profile based on a correlation of the surface data with the downhole data;

identify a change in the surface data greater than a predetermined surface threshold;

as a result of an identification of such a change, generate a query to the downhole storage device to transmit a result of a frequency analysis of the downhole data to the processor; and based on the change, alter a parameter of the fluid production system that affects operation of the electric submersible pump.

* * * * *